US011299892B2

(12) United States Patent
Bassetto et al.

(10) Patent No.: US 11,299,892 B2
(45) Date of Patent: Apr. 12, 2022

(54) HEAD FOR A SUPPORT OF RAISED FLOORS

(71) Applicant: Profilitec S.p.A. Socio Unico, Isola Vicentina (IT)

(72) Inventors: Andrea Bassetto, Isola Vicentina (IT); Roderick Egli, Isola Vicentina (IT)

( * ) Notice: Subject to any disclaimer, the term of this patent is extended or adjusted under 35 U.S.C. 154(b) by 0 days.

(21) Appl. No.: 16/973,149

(22) PCT Filed: Mar. 20, 2019

(86) PCT No.: PCT/IB2019/052263
§ 371 (c)(1),
(2) Date: Dec. 8, 2020

(87) PCT Pub. No.: WO2019/239221
PCT Pub. Date: Dec. 19, 2019

(65) Prior Publication Data

US 2021/0246668 A1 Aug. 12, 2021

(30) Foreign Application Priority Data

Jun. 15, 2018 (IT) ..... 102018000006344

(51) Int. Cl.
*E04F 15/024* (2006.01)
*E04F 15/02* (2006.01)

(52) U.S. Cl.
CPC .... *E04F 15/0247* (2013.01); *E04F 15/02452* (2013.01); *E04F 15/02183* (2013.01); *E04F 2015/02127* (2013.01)

(58) Field of Classification Search
CPC ..... E04F 15/0247; E04F 15/02452; E04F 15/02482; E04F 2015/02127; E04F 15/02183; E04D 11/007
See application file for complete search history.

(56) References Cited

U.S. PATENT DOCUMENTS 5,301,480 A * 4/1994 Oyama ..... E04F 15/02482 52/126.6
6,332,292 B1 * 12/2001 Buzon ..... E04D 11/007 248/351

(Continued)

FOREIGN PATENT DOCUMENTS

| | | |
|---|---|---|
| CN | 206917190 | 1/2018 |
| EP | 0123875 | 11/1984 |
| WO | 2014160076 | 10/2014 |

*Primary Examiner* — Theodore V Adamos
(74) *Attorney, Agent, or Firm* — Themis Law

(57) ABSTRACT

A head for supports of raised floors includes a support body having an upper surface shaped as a cavity partially counter-shaped to receive a spherical cap; a protrusion emerging from the upper surface of the support body and having a threaded side wall; a tilting element having in its upper part a flat surface for supporting building elements and in its lower part a portion partially shaped like a spherical cap configured to be laid on the support body, the tilting element having a through hole configured to receive the protrusion; and a ring nut having an inner surface and an outer lateral surface, the inner surface being threaded to mesh with the threaded portion of the side walls of the protrusion, the outer lateral surface being shaped to abut against the inner surface of the through hole in the tilting element.

4 Claims, 2 Drawing Sheets

(56) References Cited

U.S. PATENT DOCUMENTS

| | | | | |
|---|---|---|---|---|
| 9,879,385 | B2 * | 1/2018 | Tabibnia | F24D 3/127 |
| 2003/0070372 | A1 * | 4/2003 | Favero | E04F 15/02482 52/220.1 |
| 2008/0222973 | A1 * | 9/2008 | Lee | E04F 15/02488 52/126.1 |
| 2009/0183442 | A1 * | 7/2009 | Repasky | E04F 15/02183 52/126.6 |
| 2013/0219809 | A1 * | 8/2013 | Tabibnia | E04F 15/02482 52/126.6 |
| 2014/0308076 | A1 * | 10/2014 | Tabibnia | E01C 5/00 404/99 |
| 2016/0040439 | A1 * | 2/2016 | Pelc | E04F 15/203 52/126.6 |
| 2017/0152665 | A1 * | 6/2017 | Pelc, Jr. | E04F 15/02482 |

* cited by examiner

HEAD FOR A SUPPORT OF RAISED FLOORS

DEFINITIONS

In the present patent, the term "building elements" means floor covering materials such as, by way of example, tiles and planks.

FIELD OF APPLICATION

The present invention is generally applicable to the building sector and refers to the construction of raised floors.

More in detail, the present invention relates to supports and supporting feet for raised floors.

BACKGROUND ART

As is known, special ceilings and floors are used in many environments, especially in work environments such as offices, warehouses or other. This allows to arrange with ease the sub-services and to manage uneven floors or ceilings that would require particularly expensive interventions.

Another situation in which special floors, often of the raised type, are used is the case of temporary structures such as prefabricated sheds, tensile structures and, in general, structures that must be assembled and disassembled on generally uneven surfaces such as a field or similar.

Typically, raised floors have a load-bearing structure laid on the ground above which the flooring is arranged. The latter is usually made up of tiles laid on the load-bearing structure.

Due to the aforementioned disconnections or to the desired slope of the support surface (be it a floor or the ground) to facilitate the discharge of water or other, the load-bearing structure has the task of restoring the proper horizontality of the floor, i.e. of the tiles or the covering material that constitutes the floor.

Typically, the load-bearing structure comprises a plurality of supports on whose head there is a plate that supports the edges of adjacent tiles.

The supports are shaped so as to allow their height adjustment in order to regulate not only the height of the floor from the support surface, but also to ensure the flatness of the floor itself.

However, such flatness cannot be managed only through the height adjustment of the support. The inclination of the support surface would turn into the inclination of the head of the supports. This typically requires arranging specially shaped wedges under the supports to restore the horizontality of the head. Since this solution is obviously inconvenient, supports having the tilting head so that the weight of the building elements which rest on it induces the automatic angle in a horizontal direction are known.

When laying a floor, it is evident that it is not always necessary for the head to be tilting as there may be situations in which the weight of the building elements resting on it are not uniform and therefore the tilting of the head does not guarantee its horizontal position. All this would force the installers to always have more types of supports available, that is supports with a tilting head and supports with a fixed head. It is clear that this is expensive in economic terms (given the useless number of supports that must always be available), in terms of warehouse management and in terms of production management.

Supports with a tilting head are therefore known and provided with an accessory applicable to the head itself in order to fix it. This type of accessory is typically constituted by an interlocking element which, once placed in special openings on the head, blocks its movements.

Although this allows to have a single support that can switch from tilting head to fixed head, the presence of a special accessory will certainly complicate its management because of the presence of an element which is separated from the support.

Moreover, such accessories, as stated above, are inserted by interlocking on the head so that their removal, if necessary, is difficult and requires adequate instrumentation.

Moreover, the tilting element is cumbersome since the pivoting part is usually central to the head and this forces to have a particularly thick head both to make space for the tilting part, and to make space for the accessory used to fix the head. However, even the accessory is necessarily cumbersome.

PRESENTATION OF THE INVENTION

The object of the present invention is to at least partially overcome the above-mentioned drawbacks by providing a tilting head for supports of raised floors which can be fixed so as to transform it into a fixed head.

Another object of the present invention is that the switch between the tilting head configuration and the fixed head configuration is reversible at any time.

A further object is that the reversibility of the switch between the fixed head and the tilting head configuration can be repeated any number of times.

Another object of the present invention is that the head does not need separate accessories for switching between the two configurations.

A further purpose is that the passage between the two configurations can be performed even without adequate instrumentation.

Another purpose is for the thickness of the head to be independent by the method of switch between the fixed head and the tilting head configurations. A further object is that the head of the invention results as thin as possible to allow its use even in cases in which the raising of the floor is particularly limited.

Another object of the present invention is to make available a support for raised floors provided with a head that achieves all the above listed purposes. Said objects, as well as others which will become clearer below, are achieved by a head for supports of raised floors according to the following claims, which are to be considered as an integral part of the present patent.

In particular, the head comprises at least one support body having an upper surface provided with a cavity at least partially counter-shaped on a spherical cap. At least one tilting element rests on it, having in its upper part at least one surface that is at least partially flat for the support of building elements, and in its lower part at least one portion shaped like a spherical cap which is therefore intended to be laid on the support body.

The spherical cap shaping of the lower part of the tilting element and the counter-shaping again like a spherical cap of the upper surface of the support body are the features that allow the tilting element to move with respect to the support body in accordance with the weights of the building elements and with the inclinations of the underlying support surface.

According to an aspect of the invention, the support body comprises at least one protrusion emerging from its upper surface and having an at least partially threaded side wall. This protrusion invests a through hole present on the tilting element. This detail limits the reciprocal movement between the support body and the tilting element.

According to another aspect of the invention, the head also includes at least one ring nut having at least one inner surface and at least one outer surface. The inner surface is at least partially threaded to mesh with the threaded portion present on the side walls of the protrusion emerging from the support body. In this way, the ring nut can be screwed onto this protrusion so that its side walls collide with the inner surface of the through hole of the tilting element. In this way the tilting movement is interrupted because the ring nut pushes the tilting element against the support body.

In other words, the screwing and unscrewing of the ring nut on the protrusion of the support body allows to switch from a fixed head configuration, wherein the tilting element is pushed by the ring nut itself against the support body holding it in position, to a tilting head configuration wherein the ring nut is raised with respect to the tilting element which is therefore free to move with respect to the support body.

Advantageously, therefore, the switch between the tilting head configuration and the fixed head configuration is easily reversible at any time and for any number of times.

Moreover, still advantageously, the ring nut is always screwed to the protrusion of the support body, thereby avoiding the risk of loss and the expensive management of elements separated from the head.

Still advantageously, the switch between the two configurations takes place without adequate instrumentation, being possible even in a freehand manner.

From what stated above, it is evident that said objects are achieved also by a raised floor, comprising:

- a plurality of supports having a base that can be positioned on a support surface and a head operatively coupled to said base;
- a plurality of building elements forming said floor and configured to be laid on said head of one or more of said supports, and which is characterized by the fact that said head also comprises:

- at least one support body having an upper surface provided with a cavity which is counter-shaped on a spherical cap;
- at least one protrusion emerging from said upper surface of said support body and having an at least partially threaded side wall;
- at least one tilting element having in its upper part at least one flat surface to support said building elements and in its lower part at least one portion shaped like a spherical cap for being laid on said upper surface of said support body, said tilting element having a through hole which can at least partially house said protrusion of said support body;
- at least one ring nut having at least one inner surface and at least one outer surface, said inner surface being at least partially threaded to mesh with said threaded portion of said side walls of said emerging protrusion, said outer surface of said ring nut being shaped to abut against at least one portion of inner surface of said through hole of said tilting element.

BRIEF DESCRIPTION OF THE DRAWINGS

Further features and advantages of the invention will become more evident in light of the detailed description of a preferred but not exclusive embodiment of a head for supports of raised floors according to the invention, illustrated by way of non-limiting example with the aid of the accompanying drawings, wherein.

DETAILED DESCRIPTION OF SOME PREFERRED EXEMPLARY EMBODIMENTS

Figure 1:
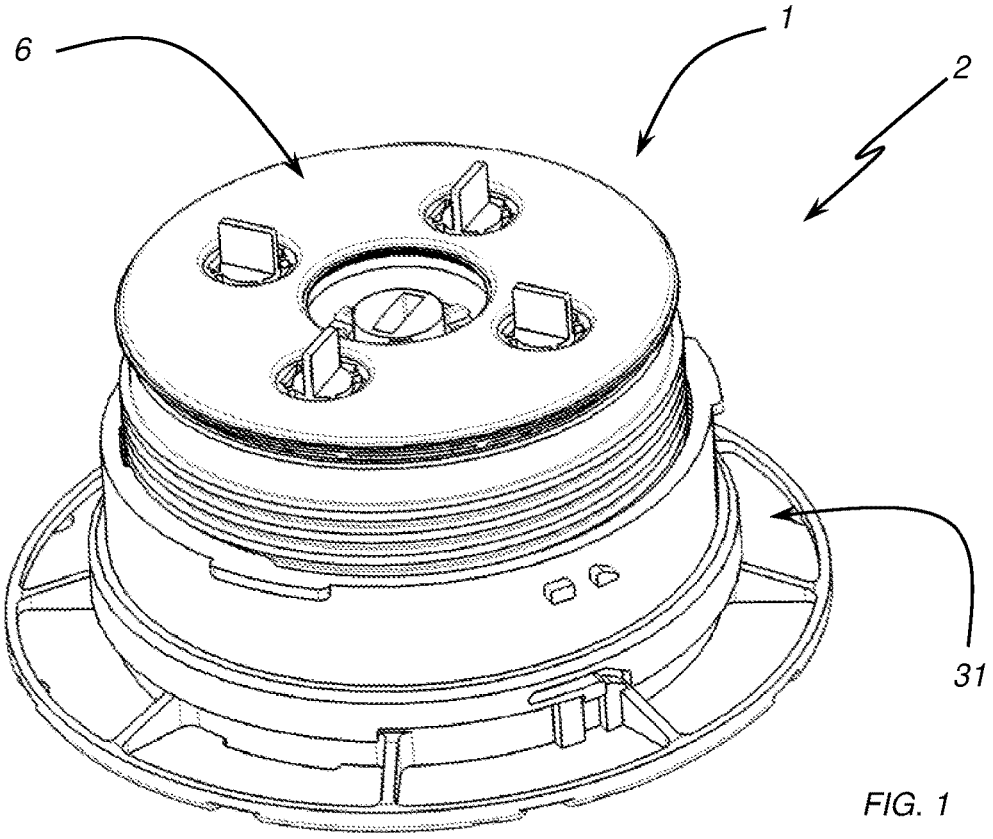
FIG. 1 represents a support for raised floors with a head according to the invention in axonometric view.
Figure 2:
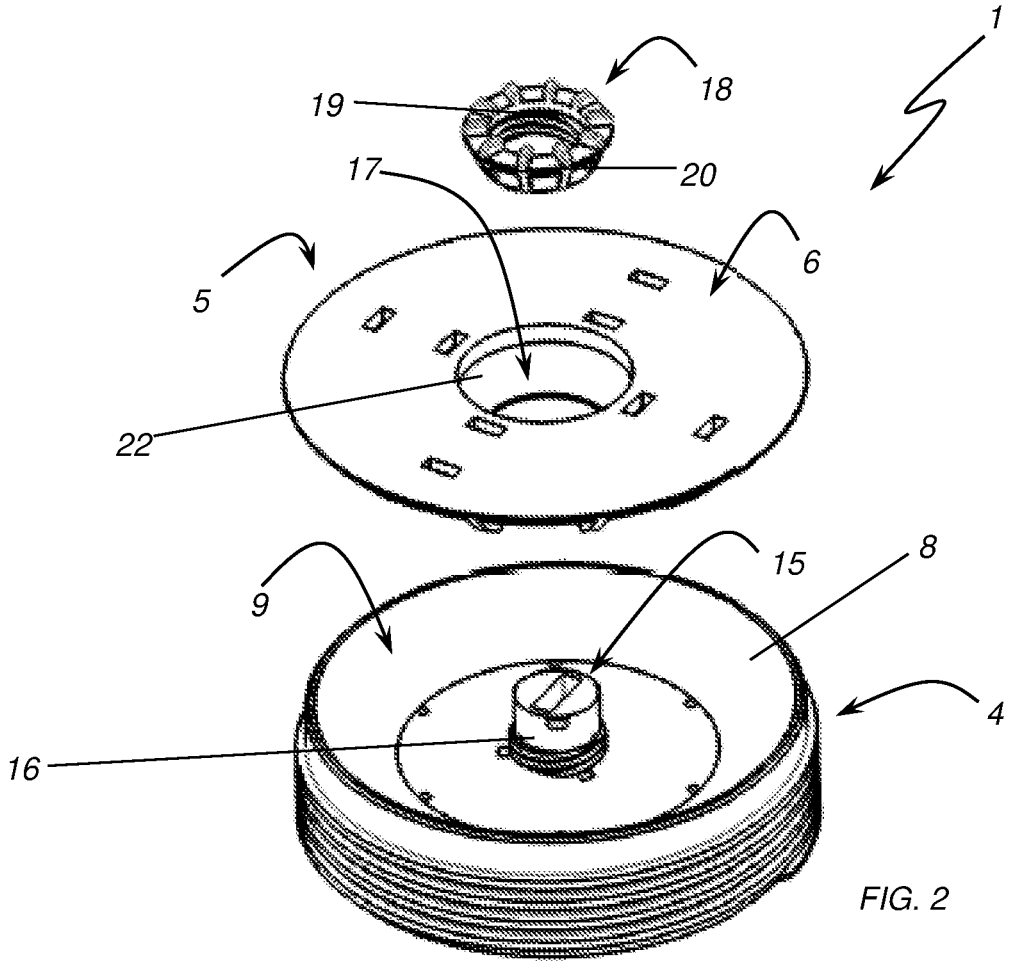
FIG. 2 represents the support of FIG. 1 in sectioned view.

With reference to the mentioned figures, and in particular to FIGS. 1 and 2, it is disclosed a head 1 for supports 2 of raised floors.

As is known, the head of a support is the part of the support on which the building elements that constitute the raised floor rest.

In this sense, the head 1 of the invention comprises a support body 4 and a tilting element 5 which rests on it. The latter has a flat surface 6 at the top for supporting building elements such as, for example, tiles, planks or the like.

From the figures it is clear that not all the upper part of the tilting element 5 constitutes the flat surface 6. Indeed, this feature should not be considered as a limiting feature for the present invention. What matters is that at least one portion of the upper part of the tilting element 5 is at least partially flat in order to favour a correct support of the building elements.

Figure 3:
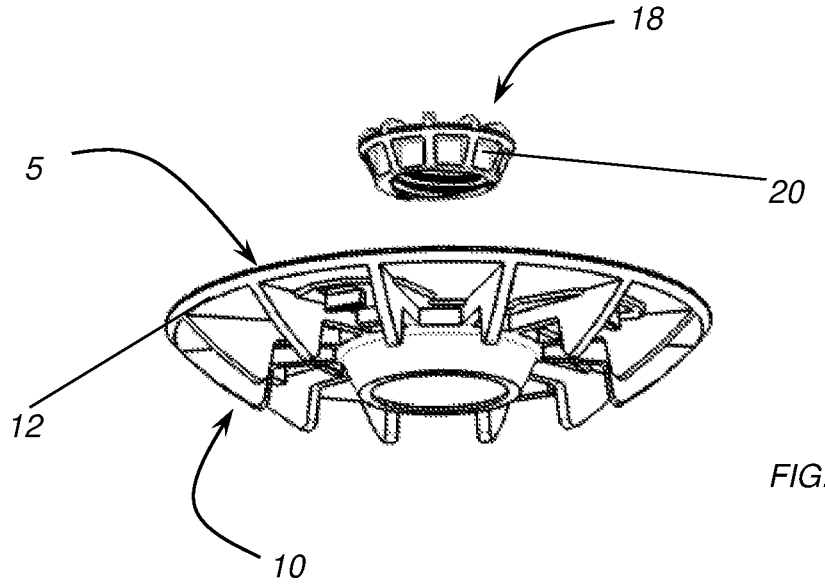

According to another aspect of the invention, the tilting element 5, as its name suggests, must be able to move with respect to the support body 4. In this sense, the latter has the upper surface 8 provided with a cavity 9 counter-shaped on a spherical cap. At the same time, the tilting element 5 has in its lower part, as can be seen in FIG. 3, a portion 10 shaped as a spherical cap for being laid movably on the upper surface 8 of the support body 4.

In other words, the reciprocal movement between the tilting element 5 and the support body 4 is favoured by the spherical cap shaping of the lower part of the tilting element and by the counter-shaping according to said spherical cap of the upper surface 8.

This configuration, moreover, facilitates the self-levelling of the floor since the weight of the tiles or the like resting on the tilting element 5 forces the latter to move with respect to the support body 4 and to arrange itself with an inclination in accordance with such weights.

According to a further aspect of the invention, the portion 10 shaped as a spherical cap of the tilting element 5 identifies, in plan projection, a circular crown close to the perimeter edge 12 of the same tilting element 5. In other words, in the lower part of the tilting element 5 there is a circular crown portion 10 which is shaped like a spherical cap and which in fact identifies a spherical cap crown. It is close to the perimeter edge 12 of the tilting element 5, leaving the manufacturer the advantage of freely shaping the central part of the lower portion of the tilting element 5 itself.

This also entails further advantages.

First of all, the support surface of the tilting element 5 on the support body 4 is in any case particularly extended being constituted by the area of the circular crown identified by the portion of spherical cap.

Still advantageously, the displacement of the portion of spherical cap which generates the movement on the periphery, the thickness of the portion of spherical cap necessary to obtain certain degrees of inclination of the tilting element 5 will be less than that required if the cap were totally made involving also its central part. In other words, the cutting of the central part of the cap does not prevent the element 5 from tilting on the support body 4, but making it less thick.

According to another aspect of the invention, the support body 4 comprises a protrusion 15 emerging from its upper surface 8 and having threaded side walls 16. In the drawings it can be seen that this protrusion 15 is substantially a cylinder, but this should not be considered a limiting characteristic for the invention.

At the same time, the tilting element 5 is provided with a through hole 17 which can accommodate the protrusion 15 to make it accessible.

The head 1 then also comprises a ring nut 18 having the inner surface 19 threaded to mesh with the thread of the side walls 16 of the emerging protrusion 15. The lateral surface 20 of the ring nut 18 is moreover shaped to abut against the inner surface 22 of the through hole 17 of the tilting element 5.

To sum up, therefore, there is a ring nut 18 which meshes with a protrusion 15 emerging from the upper surface 8 of the support body 4. The tilting element 5 is interposed between the ring nut 18 and the upper surface 8 of the support body 4 so that it cannot be separated from the support body 4.

Figure 4:
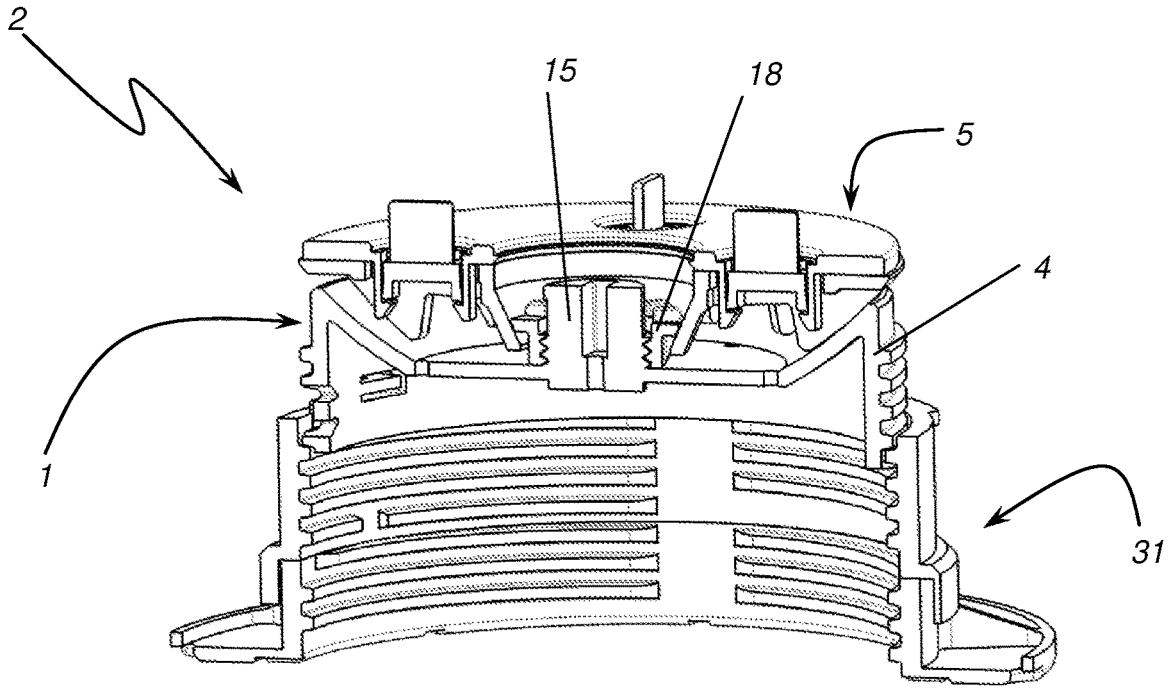
FIGS. 3 and 4 represent details of a head according to the invention.

It can be deduced that the tilting element 5 is in any case free to move, but a complete screwing of the ring nut 18 onto the protrusion 15 realizes, as shown in FIG. 4, a thrust on the tilting element 5 towards the support body 4 which causes its stabilization, preventing any movement thereof. In other words, advantageously, the screwing of the ring nut allows to pass from a mobile head 1 configuration to a fixed head 1 configuration.

Still advantageously, it is evident that the switch from the fixed head 1 configuration to the mobile head 1 configuration is reversible simply by unscrewing the ring nut 18. In particular, still advantageously, the passage from one configuration to the other can be carried out any number of times without any problem.

However, the process is advantageously simple and typically executable without the need for adequate instrumentation.

Moreover, the ring nut 18 does not necessarily have to be separated from the head 1 since it is sufficient to unscrew it only partially from the protrusion 15, thereby avoiding having accessories detached from the remainder 1 which would be easy to lose and would also create problems in warehouse management.

Still advantageously, the fact that the head 1 is not very thick thanks to the displacement of the shaped portion 10 of the tilting element 5 towards its periphery allows the ring nut 18 and the protrusion 15 to be of limited dimensions.

According to another aspect of the invention, the lateral surface 20 of the ring nut 18 is shaped like a truncated cone. At the same time, the inner surface 22 of the through hole 17 of the tilting element 5 is counter-shaped like a truncated cone.

In this way, advantageously, the screwing of the ring nut 18 automatically and easily guides the tilting element 5 towards the support body 4 realizing the desired support and making the two elements stably coupled.

From what has been said it is evident that the object of the invention is also a raised floor comprising:

a plurality of supports 2 having a base 31 which can be positioned on a support surface and a head 1 operatively coupled to the base 31.

a plurality of building elements forming the floor (not visible in the drawings) and configured to be laid on the head 1 of one or more supports 2.

The head 1, in such case, is exactly like the one described so far, and a precise description thereof is omitted since it would be repetitive of what has been said so far.

In light of the foregoing, it is understood that the head and the floor of the invention both achieve the prefixed purposes.

In particular, the head can be both tilting and fixed, thereby facilitating the management of the supports.

The switch between the tilting head configuration and the fixed head configuration is reversible at any time, repeatable for any number of times and executable without proper instrumentation.

There are no separate accessories, therefore the management of the components is also simplified compared to known equivalent heads.

The invention might be subject to many changes and variants, which are all included in the appended claims. Moreover, all the details may furthermore be replaced by other technically equivalent elements, and the materials may be different depending on the needs, without departing from the protection scope of the invention defined by the appended claims.

The invention claimed is:

1. A head for supports of raised floors comprising:

a support body having an upper surface shaped as a cavity that is at least partially counter-shaped to receive a spherical cap;

a protrusion emerging from said upper surface of said support body and having an at least partially threaded side wall, said protrusion and said upper surface being made as a single piece;

a tilting element having in an upper part thereof a surface that is at least partially flat to support building elements and in a lower part thereof at least one portion at least partially shaped as a truncated spherical cap configured to be laid on said upper surface of said support body, said tilting element having a through hole which is shaped to at least partially house said protrusion; and a ring nut having an inner surface and an outer lateral surface, said inner surface being at least partially threaded to mesh with said at least partially threaded side wall of said protrusion, said outer lateral surface of said ring nut being shaped to abut against at least one portion of an inner lateral surface of said through hole of said tilting element, wherein said portion of said tilting element shaped as a truncated spherical cap defines a circular crown ending adjacently to a perimeter edge of said tilting element.

2. The head according to claim 1, wherein said ring nut has at least the outer lateral surface shaped as a truncated cone.

3. The head according to claim 2, wherein said through hole of said tilting element has at least the inner surface counter-shaped on said truncated cone.

4. A raised floor comprising:

a plurality of supports each having a base adapted to be positioned on a support surface and a head operatively coupled to said base;

a plurality of building elements forming said floor and configured to be laid on said head of one or more of said plurality of supports, wherein said head comprises:

a support body having an upper surface provided with a cavity at least partially counter-shaped on a spherical cap;

a protrusion emerging from said upper surface of said support body and having an at least partially threaded side wall, said protrusion and said upper surface being made as a single piece;

a tilting element having in an upper part thereof at least one surface that is at least partially flat to support building elements and in a lower part thereof at least one portion at least partially shaped as a truncated spherical cap configured to be laid on said upper surface of said support body, said tilting element having a through hole which is shaped to at least partially house said protrusion of said support body; and a ring nut having an inner surface and an outer lateral surface, said inner surface being at least partially threaded to mesh with said at least partially threaded side wall of said protrusion, said outer lateral surface of said ring nut being shaped to abut against at least one portion of an inner lateral surface of said through hole of said tilting element, wherein said portion of said tilting element shaped at least partially as a truncated spherical cap defines a spherical crown ending adjacently to a perimeter edge of said tilting element.

* * * * *